US008170426B2

(12) United States Patent
Higashiuchi et al.

(10) Patent No.: US 8,170,426 B2
(45) Date of Patent: May 1, 2012

(54) IMAGE FORMING SYSTEM, IMAGE FORMING DEVICE AND INFORMATION PROCESSING DEVICE

(75) Inventors: Hirokazu Higashiuchi, Toyokawa (JP); Masatoshi Hitaka, Toyokawa (JP); Masao Kondo, Toyokawa (JP); Toshiya Furubayashi, Toyokawa (JP); Masazumi Ito, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 277 days.

(21) Appl. No.: 11/785,235

(22) Filed: Apr. 16, 2007

(65) Prior Publication Data

US 2007/0280709 A1 Dec. 6, 2007

(30) Foreign Application Priority Data

Apr. 26, 2006 (JP) ..... 2006-122724

(51) Int. Cl.
*G03G 15/00* (2006.01)

(52) U.S. Cl. ..... 399/13; 399/75; 399/12

(58) Field of Classification Search ..... 399/13
See application file for complete search history.

(56) References Cited

U.S. PATENT DOCUMENTS

| | | | | |
|---|---|---|---|---|
| 5,159,546 | A * | 10/1992 | Inoue et al. | 700/17 |
| 6,734,985 | B1 | 5/2004 | Ochiai | |
| 6,747,754 | B1 | 6/2004 | Iyoki | |
| 6,876,825 | B2 * | 4/2005 | Kurahashi et al. | 399/82 |
| 6,915,090 | B2 | 7/2005 | Fukaya | |
| 6,975,819 | B2 | 12/2005 | Katamoto | |
| 2003/0179390 | A1 * | 9/2003 | Kitozaki | 358/1.6 |
| 2005/0180771 | A1 * | 8/2005 | Kurahashi et al. | 399/82 |
| 2005/0207789 | A1 | 9/2005 | Inukai et al. | |
| 2006/0077425 | A1 | 4/2006 | Nakata et al. | |
| 2006/0133844 | A1 * | 6/2006 | Konno | 399/82 |
| 2006/0239708 | A1 * | 10/2006 | Kozuka et al. | 399/75 |
| 2006/0285868 | A1 * | 12/2006 | Holmes | 399/81 |

FOREIGN PATENT DOCUMENTS

| | | |
|---|---|---|
| JP | 07-152507 | 6/1995 |
| JP | 2003-320711 | 11/2003 |
| JP | 2004-005463 A | 1/2004 |
| JP | 2005-128966 A | 5/2005 |
| JP | 2005-195843 A | 7/2005 |
| JP | 2006-109277 | 4/2006 |

OTHER PUBLICATIONS

Notification of Reasons for Refusal in JP 2006-122724 dated Apr. 1, 2008, and Translation thereof.

* cited by examiner

*Primary Examiner* — David Gray
*Assistant Examiner* — Roy Y Yi
(74) *Attorney, Agent, or Firm* — Buchanan Ingersoll & Rooney PC

(57) ABSTRACT

Provides is an image forming system, comprising an image forming device and an information processing device connected to the image forming device, further comprising a function-detecting unit detecting that a second function is added to the image forming device having a first function, and a notification unit notifying the user using the first function of the fact that the second function is added when addition thereof is detected by the function-detecting unit.

19 Claims, 13 Drawing Sheets

IMAGE FORMING SYSTEM, IMAGE FORMING DEVICE AND INFORMATION PROCESSING DEVICE

This application claims priority under 35 U.S.C. §119 to Japanese Patent Application No. 2006-122724 filed on Apr. 26, 2006, the entire disclosure of which is incorporated herein by reference in its entirety.

BACKGROUND OF THE INVENTION

1. Field of the Invention

The present invention relates to an image forming system having an image forming device connected to an information processing device via a network such as MFP (Multi Function Peripheral), an image forming device, and an information processing device.

2. Description of the Related Art

The following description sets forth the inventor's knowledge of related art and problems therein and should not be construed as an admission of knowledge in the prior art.

Image forming devices having multiple functions, for example having a monochromic printing function and a full color printing function interchangeably, and image forming systems using such an image forming device have been known (e.g., Japanese Unexamined Patent Publication 2005-195843).

Such an image forming devices having both monochromic full-color printing functions often had only a monochromic printing function at first and later, had an additional full-color printing function.

However, in such a case, there were many user who, not knowing that the printer is compatible with full-color printing, continued to perform only monochromic printing of color data that can be printed in full color even after the full-color printing function is added, and thus, there was still a problem in convenience.

Japanese Unexamined Patent Publication 2005-128966 discloses a method of notifying particular users that there is change, for example, when there is change such as modification or failure in the terminal device connected to a printer, when the printing reservation time elapsed, prohibiting reserved printing, or when there is change in the managed file information.

Alternatively, Japanese Unexamined Patent Publication 2004-5463 discloses a system notifying the users of the information about the consumables used in the printer or the like.

However, the methods described in the Japanese Unexamined Patent Publications 2005-128966 and 2004-5463 are both not the method used when a new function is added to the image forming device, and thus, are not effective in solving the problem in convenience for the users who continue to perform only monochromic printing even after a full-color printing function is added.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

An object of the present invention is to provide an image forming system that allows the user who uses a first function even after a second function is added to an image forming device having the first function to recognize that the second function is added.

Another object of the present invention is to provide an image forming device that allows the user who uses a first function even after a second function is added to an image forming device having the first function to recognize that the second function is added.

Yet another object of the present invention is to provide an information processing device that allows the user who uses a first function even after a second function is added to an image forming device having the first function to recognize that the second function is added.

According to a first aspect of the preferred embodiment of the present invention, provided is an image forming system, comprising an image forming device and an information processing device connected to the image forming device, further comprising a function detecting unit detecting that a second function is added to the image forming device having a first function, and a notification unit notifying the user using the first function of the fact that the second function is added when addition thereof is detected by the function detecting unit.

According to a second aspect of the preferred embodiments of the present invention, provided is an image forming device, comprising a function detecting unit of detecting that a second function is added to a first function, and a notification unit of notifying the user who uses the first function that the second function is added when addition of the second function is detected by the function detecting unit.

According to a third aspect of the preferred embodiments of the present invention, provided is an information processing device connectable to an image forming device, comprising a receiver unit of receiving a signal transmitted from the image forming device that is detected when a second function is added to the image forming device having a first function, and a notification unit of notifying receipt of the signal when the receiver unit receives the detection signal.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspects or features of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that other modifications can be made by those in the art based on these illustrated embodiments.

Figure 1:
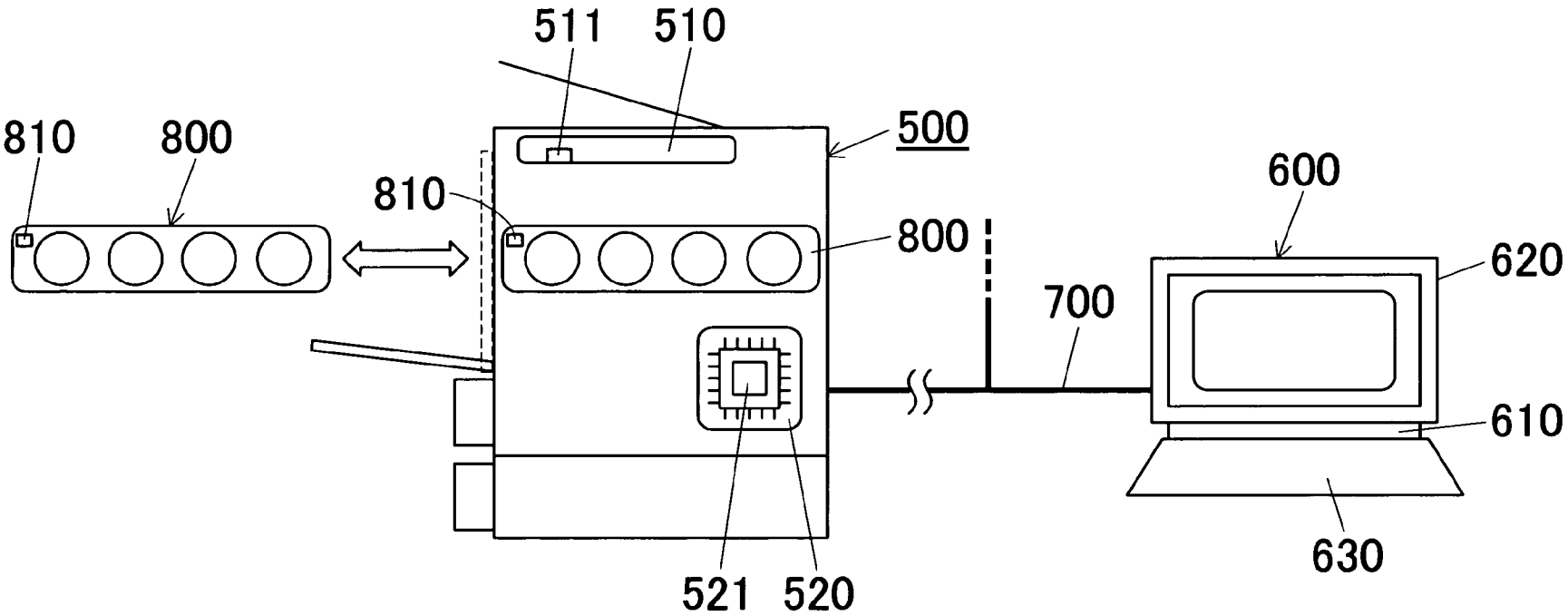
FIG. 1 is a schematic view illustrating the configuration of the image forming system in an embodiment of the present invention.

FIG. 1 is a schematic view illustrating the configuration of the image forming system in an embodiment of the present invention.

In FIG. 1, the image forming system has an image forming device 500 and a personal computer (hereinafter, referred to as PC) 600, an example of the user terminal as an information processing device, and the image forming device 500 and the PC 600 are connected to each other via a network 700 for example of a wired or wireless LAN.

In the present embodiment, the image forming device 500 is a printer in a multifunctional processing machine MFP (Multi Function Peripheral) having a printing function, a copying-machine function, a data-transmitting function such as facsimile function or scanning function, a data-converting function, and others, which has additionally a removable imaging cartridge 800, a controller 510, and an engine-controlling unit 520. Hereinafter, the image forming device 500 is referred to also as printer 500.

The printer 500 has a first function and another second function later added, and is operative in both functions, but in the present embodiment, for example a case where the first function is a monochromic printing-machine function and the second function is a full-color printing function, which is higher functionally than the monochromic printing machine function, will be described.

The imaging cartridge 800 has a full color toner cartridge and also a nonvolatile memory 810, and the data on the toner cartridge such as color information are stored in the nonvolatile memory 810.

The controller 510 controls the entire printer 500 integrally, and can also determine, for example, the printing color. The controller 510 has a nonvolatile memory 511 storing the use history of the printer by each user.

The engine-controlling unit 520 controls the printer engine (not shown in the Figure), and has a function as a means of detecting whether the current printer 500 is in accord with a monochromic or full-color machine specification, based on the color information from the imaging cartridge 800. The name of printer 500 shown in the display 620 of PC 600 when the monochromic specification is replaced with the full-color machine specification is previously registered in the memory 521, for example, by a manager user.

The PC 600 has a PC main body 610 and a display 620 as display means, a keyboard 630, and others, and various data, application software, and printer drivers are stored in its memory devices such as hard disk (HDD) (not shown in the Figure) in the PC main body 610.

The printer driver has functions to display/select a printer 500 at the output site and to specify, for example, a printing mode.

The PC 600 sends a printing instruction from the application software via the printer driver to the controller 510 of printer 500.

In other words, the controller 510 of printer 500 receives a detection signal indicating that the printer becomes compatible with full color printing as a full-color printing function is added to the monochromic printing-machine function, from the engine-controlling unit 520 and transmits it to PC 600 when the printer 500 is replaced from in the monochromic specification to in the full-color machine specification.

Use history of each user after the full-color printing function is added is stored in the nonvolatile memory 511, and the controller 510 can specify, based on the use history, the user using the printer 500 only in the monochromic printing mode and the user who used the printer in the monochromic printing mode certain times or more within a certain period after change to the full-color printing mode. The PC 600 notifies such a user once again that the full-color printing function is added.

In this way, the use history of each user is stored in the nonvolatile memory 511 after addition of the full-color printing function, and thus, it is possible to lower the capacity of the storage region to subliminal and to specify the user to be re-notified accurately. The use history of each user may of course be stored in the nonvolatile memory 511 before addition of the full-color printing function.

The PC 600 receives the signal transmitted from the printer 500 indicating that the full-color printing function is added, and notifies the user that the printer 500 is compatible with full color printing with the full-color printing function added.

In the present embodiment, such a notification is performed, as a notice is displayed on the screen of display 620.

The name of printer 500 as second display (hereinafter, referred to as switched name) is displayed, side by side with the name as first display during monochromic printing (hereinafter, referred to as old name), on the printer-driver screen of the display 620, to make the user recognize that the full-color printer is available. Alternatively, the switched name may be displayed separately, in addition to the display of the old name of printer, in the printer driver screen.

The switched name displayed on the printer driver screen may be stored previously in the nonvolatile memory 521 or 511 of printer 500 or in the printer driver of PC 600, and the switched name of the printer 500 may be displayed as it is retrieved for notification to the user.

Generally, considering that many users confirm the name of printer 500 displayed during printing via a printer driver from an application, it is possible to notify the user that the printer is compatible with full color printing reliably, by notifying the user that the full-color printing function is added with only minimal display only on the screen as described above when printing instruction is given on application.

Alternatively, re-notification of the fact that the full-color printing function is added to a particular user may be performed with an electronic mail or by a pop-up display on display 620, as will be described below. It is in this way possible to notify the user who does not recognize that the full-color printing function is added of the fact reliably.

Figure 2:
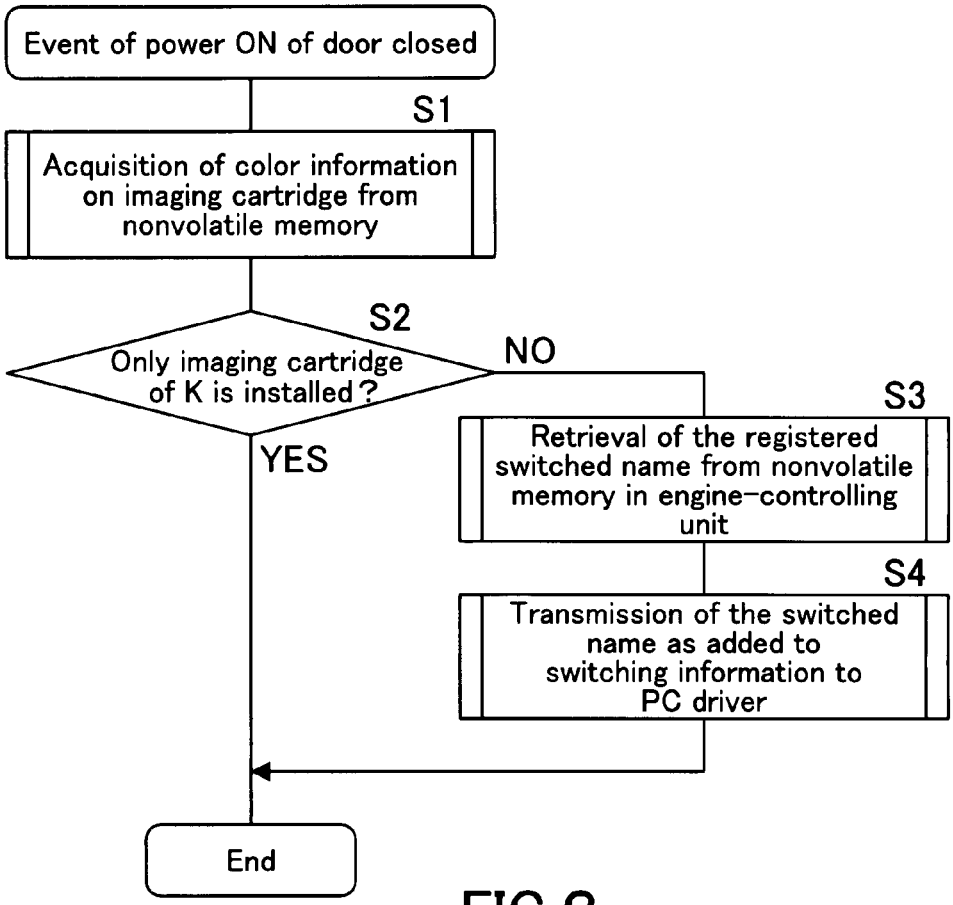
FIG. 2 is a flowchart showing the processing when the printer in the image forming system is changed from in the monochromic-machine specification to in the color-machine specification.

FIG. 2 is a flowchart showing the processing performed in the printer 500 when the printer 500 is changed from in the monochromic specification to in the full-color machine specification (when the full-color printing function is added to the monochromic printing machine function).

In FIG. 2, the color information of imaging cartridge 800 is obtained from the nonvolatile memory 810 of imaging cartridge 800 when the power is turned on or the door is closed, i.e., when the imaging cartridge 800 is possibly exchanged, in step S1; and the engine-controlling unit 520 judges whether only a black (K) toner cartridge is placed on the imaging cartridge 800 in step S2.

If only the black (K) toner cartridge is placed on the imaging cartridge 800 (YES in step S2), it is judged that it is in the monochromic specification, and the processing terminates then without any particular control. If the imaging cartridge 800 has not only a black (K) toner cartridge but also a suitable combination of color toner cartridges (NO in step S2), the switched name of printer 500 previously registered in the nonvolatile memory 521 of engine-controlling unit 520 is retrieved in step S3.

The switched name retrieved is then added to the detection signal indicating that the printer is changed into the full-color machine specification (hereinafter, referred to as switching information) by the controller 510 in step S4, and the switching information is transmitted to the PC 600. Transmission of the switching information may be performed when the printer driver of PC 600 accesses to the printer 500.

Figure 3:
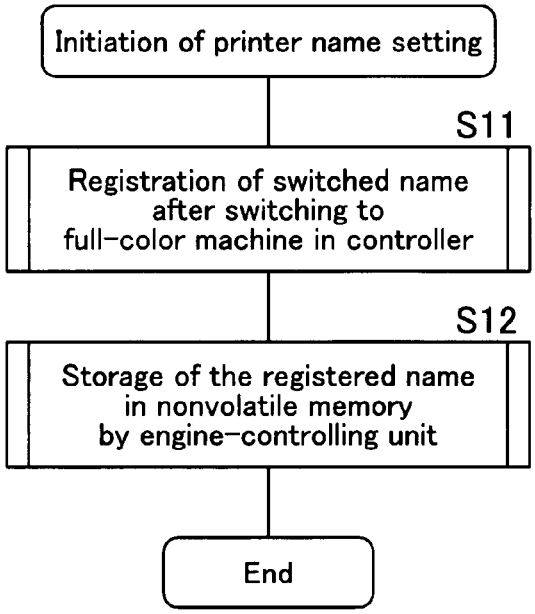
FIG. 3 is a flowchart showing the processing when a manager user, for example, registers the printer name displayed when the printer is changed from in the monochromic-machine specification to in the color-machine specification.

FIG. 3 is a flowchart showing the processing when a manager user, for example, registers the switched name in the nonvolatile memory 521 of engine-controlling unit 520.

When a manager user, for example, inputs the switched name, which will be displayed after switching to the full-color machine specification, from the operational panel not shown in the Figure of the printer 500, the switched name is registered in the controller 510 in step S11; and the engine-controlling unit 520 or the controller 510 writes the registered switched name in nonvolatile memory 521 or 511 in step S12. The switched name may be registered via the PC 600, or may be registered in the printer driver of PC 600 instead of the printer 500.

Figure 4:
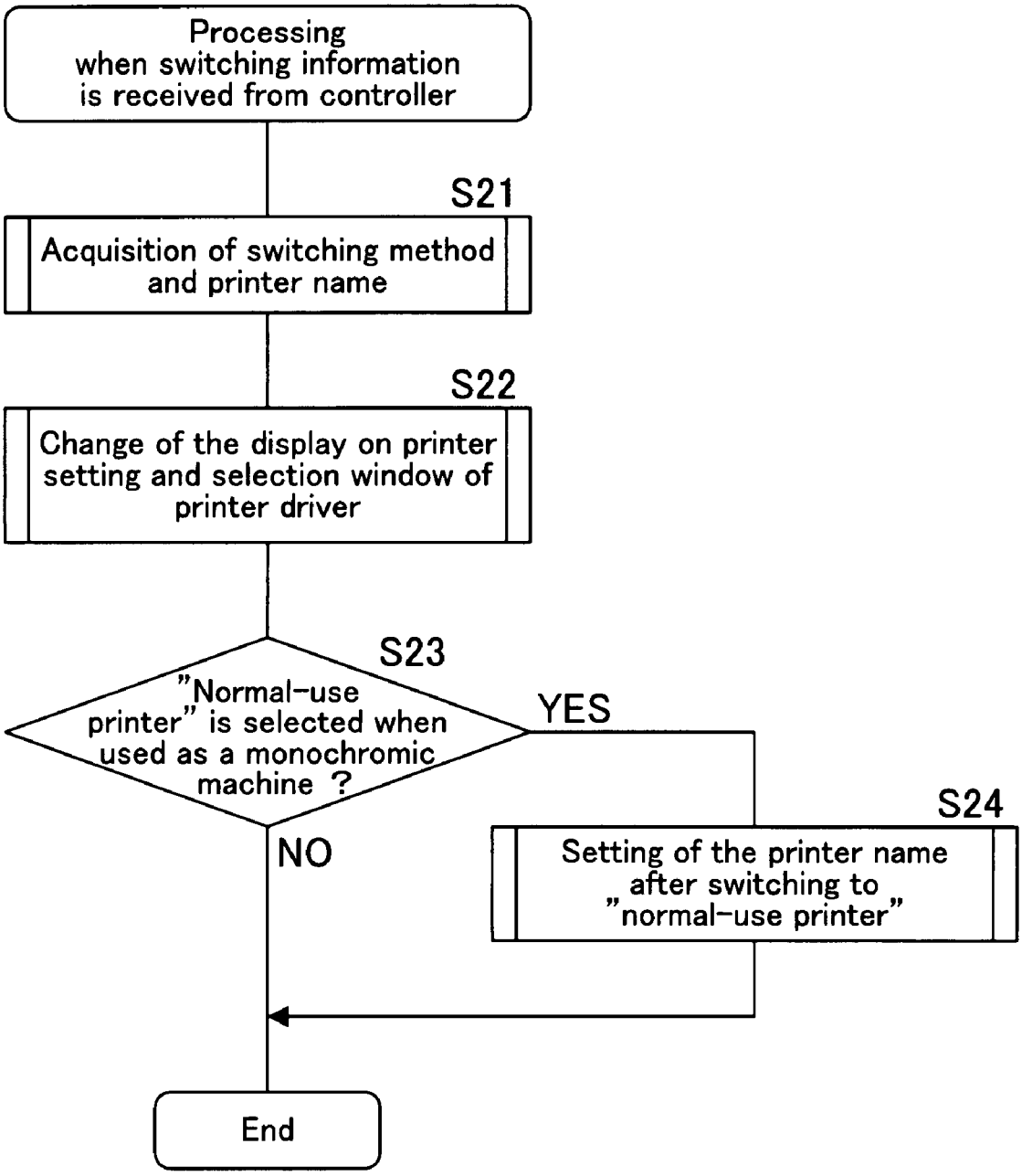
FIG. 4 is a flowchart showing the printer name-switching processing for notification to the user that is performed when the user terminal receives the switching information transmitted from the printer.

FIG. 4 is a flowchart showing the processing for switching the printer name as notification to user, which is performed when the PC 600 retrieves the switching information transmitted from the controller 510.

In FIG. 4, when the switching information is received from the printer 500, the switched name is obtained from the switching information transmitted in step S21; the name displayed on the printer setting-selection screen of printer driver is changed in step S22. Typical form of the display will be described below.

It is judged whether the old name printer is selected as the "normal-use printer" when in monochromic machine specification in step S23; if it is not selected as the "normal-use printer" (NO in step S23), the processing terminates; if it is selected as the "normal-use printer" (YES in step S23), the printer displayed by the switched name is set to the "normal-use printer" in step S24; and the processing terminates.

Figure 5:
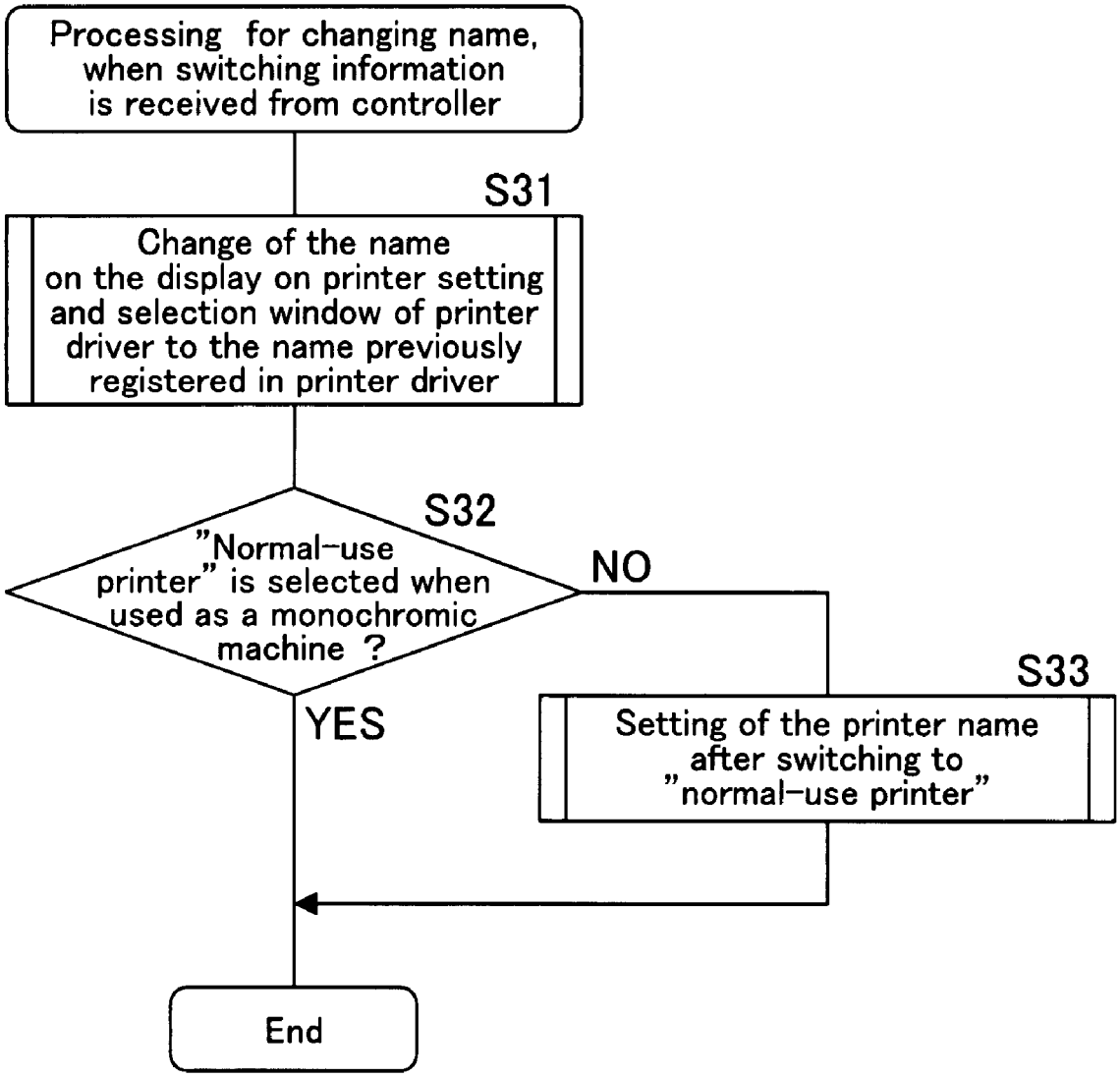
FIG. 5 is a flowchart showing another example of the printer name-switching processing shown in FIG. 4.

FIG. 5 is a flowchart showing another example of the printer name-switching processing shown in FIG. 4. The example above is a processing when the switched name is registered in the printer driver of PC 600.

In FIG. 5, when the switching information is received from printer 500 in step S31, the printer name displayed on the printer setting-selection screen of printer driver is replaced with the switched name previously registered in the printer driver. Typical form of the display will be described below.

It is the judged whether the old name printer is selected as the "normal-use printer" when in monochromic specification in step S32; if it is not selected as the "normal-use printer" (NO in step S32), the processing terminates; if it is selected as the "normal-use printer" (YES in step S32), the printer displayed by the switched name is set to the "normal-use printer" in step S33; and the processing terminates.

Figure 6:
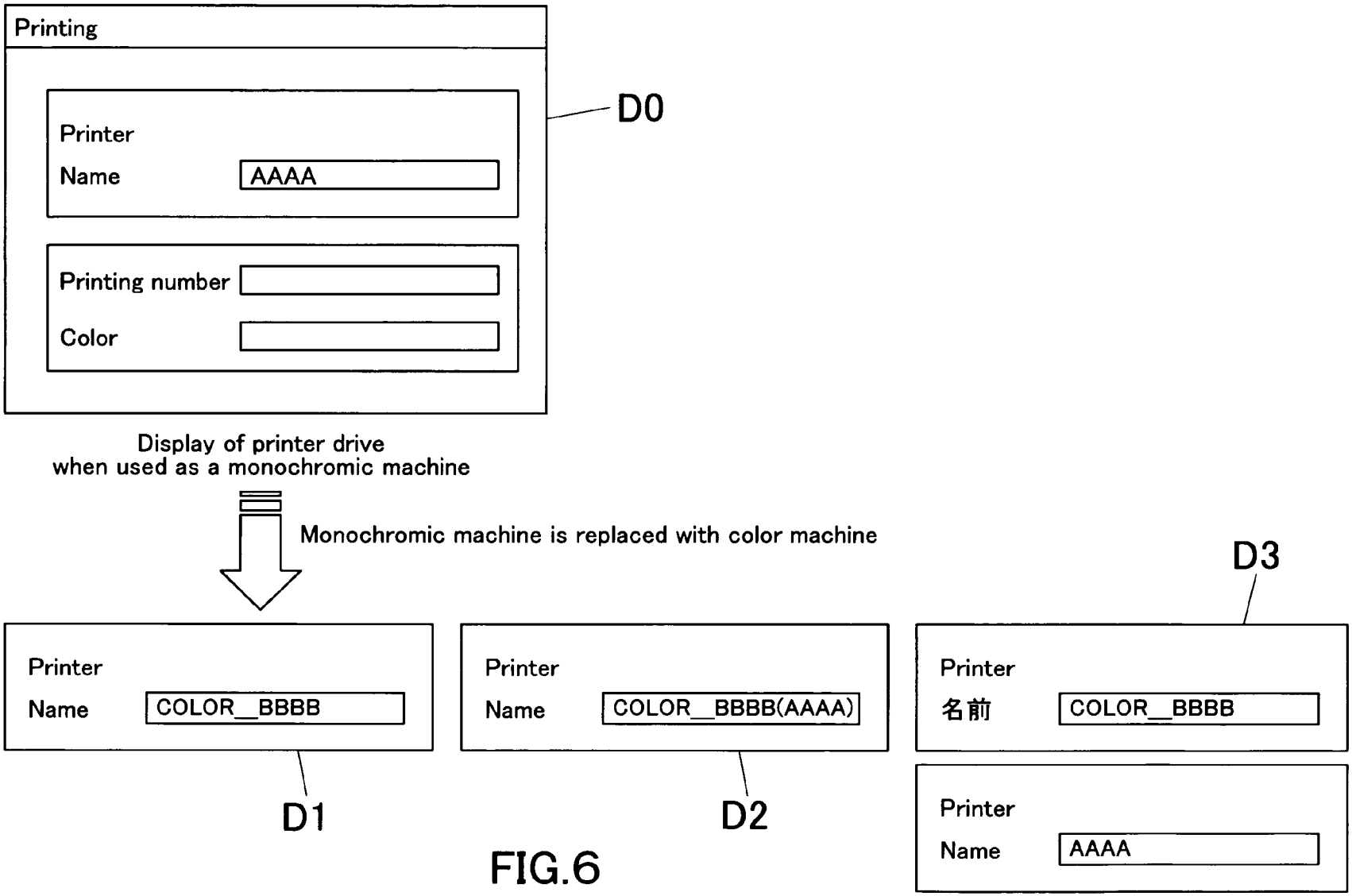
FIG. 6 is a drawing showing an example of the display in the printer driver screen of the user terminal display when the printer name is switched.

An example of the display on the printer driver screen of the display 620 of PC 600 when the name of printer 500 is replaced will be described with reference to FIG. 6.

The display screen D0 is a display screen before switching. In the screen, the old printer name "AAAA" when the printer 500 is in the monochromic specification is displayed.

Displays D1 to D3 are respectively examples of the display screen after switching, respectively showing only the display area indicating the printer name, and the display of typical operational conditions such as printing number and printing mode is omitted in the Figure.

In display screen D1, the printer name has changed to a switched name of "COLOR BBBB" after the printer is changed into the color-machine specification. In display screen D2, the switched name is displayed side by side with the old name "AAAA" in the monochromic-machine specification, and, for example, the switched name is displayed with the old name "AAAA" shown in parenthesis, as in "COLOR BBBB (AAAA)". The switched name "COLOR BBBB" is registered previously in printer 500 or PC 600 as described above.

Figure 7A:
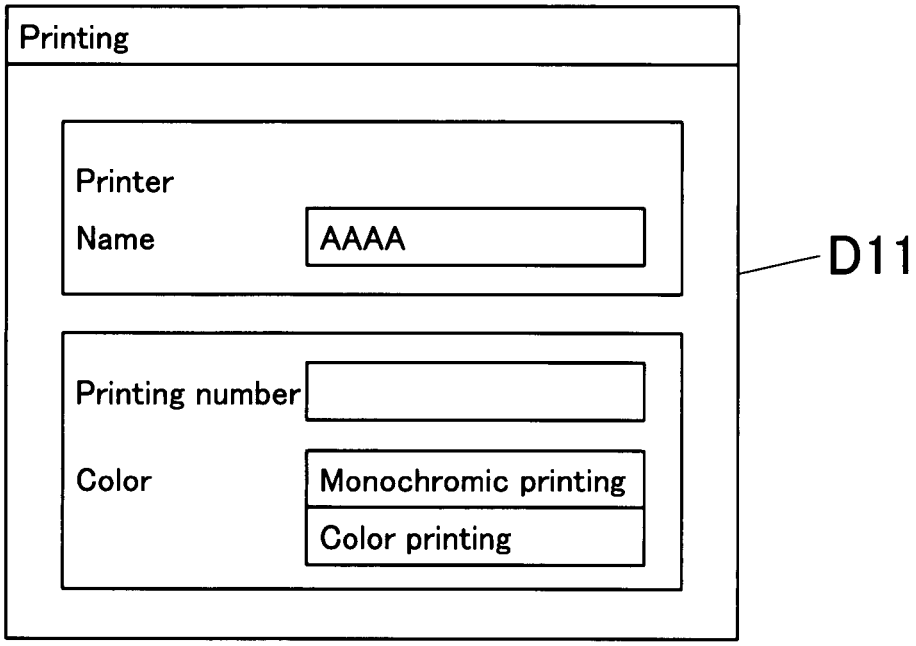
FIG. 7 is a drawing showing the display screen when a user instructs printing by selecting a printer name and specifying the printing number and the printing mode in the printer driver screen.
Figure 7B:
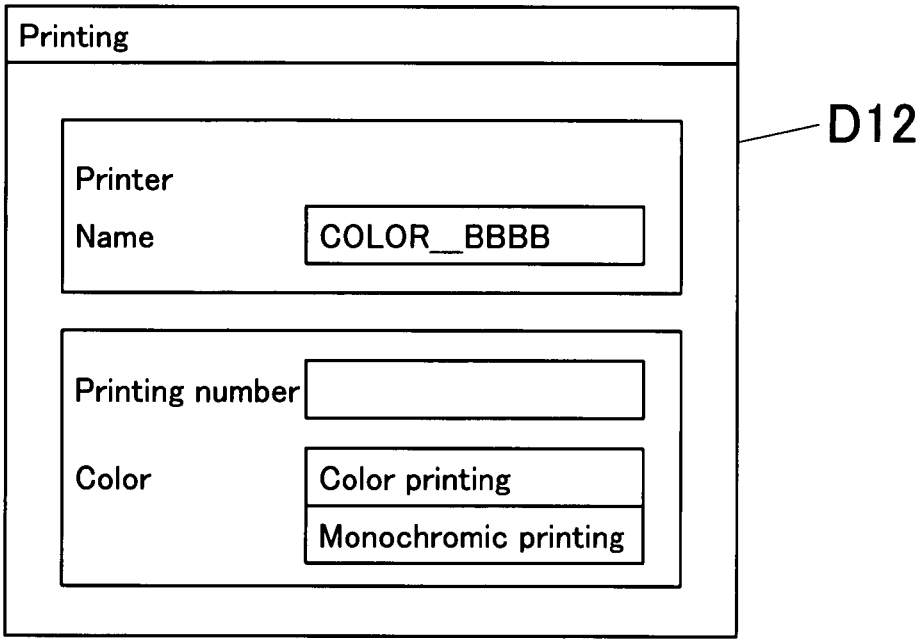

Alternatively, display screen D3 shows an example in which the display of the old name "AAAA" is preserved in the display window and the switched name "COLOR BBBB" is displayed in another display window. The user can recognize both the old and switched names in this case too. The user selects the printer name and instructs printing by designating the printing number and the printing mode in the printer driver screen shown in FIG. 6, but, in the present embodiment, as shown in the display screen D11 of FIG. 7(A), it is judged that the printer is in the full-color printer mode and the printer 500 performs full-color printing, if the color printing mode is selected as the printing mode, even when the old name is selected as the printer name after the full-color printing function is added. On the contrary, as shown in the display screen D12 of FIG. 11(B), the printer 500 performs monochromic printing if the monochromic printing mode is selected as the printing mode even when the switched name is shown.

Figure 8:
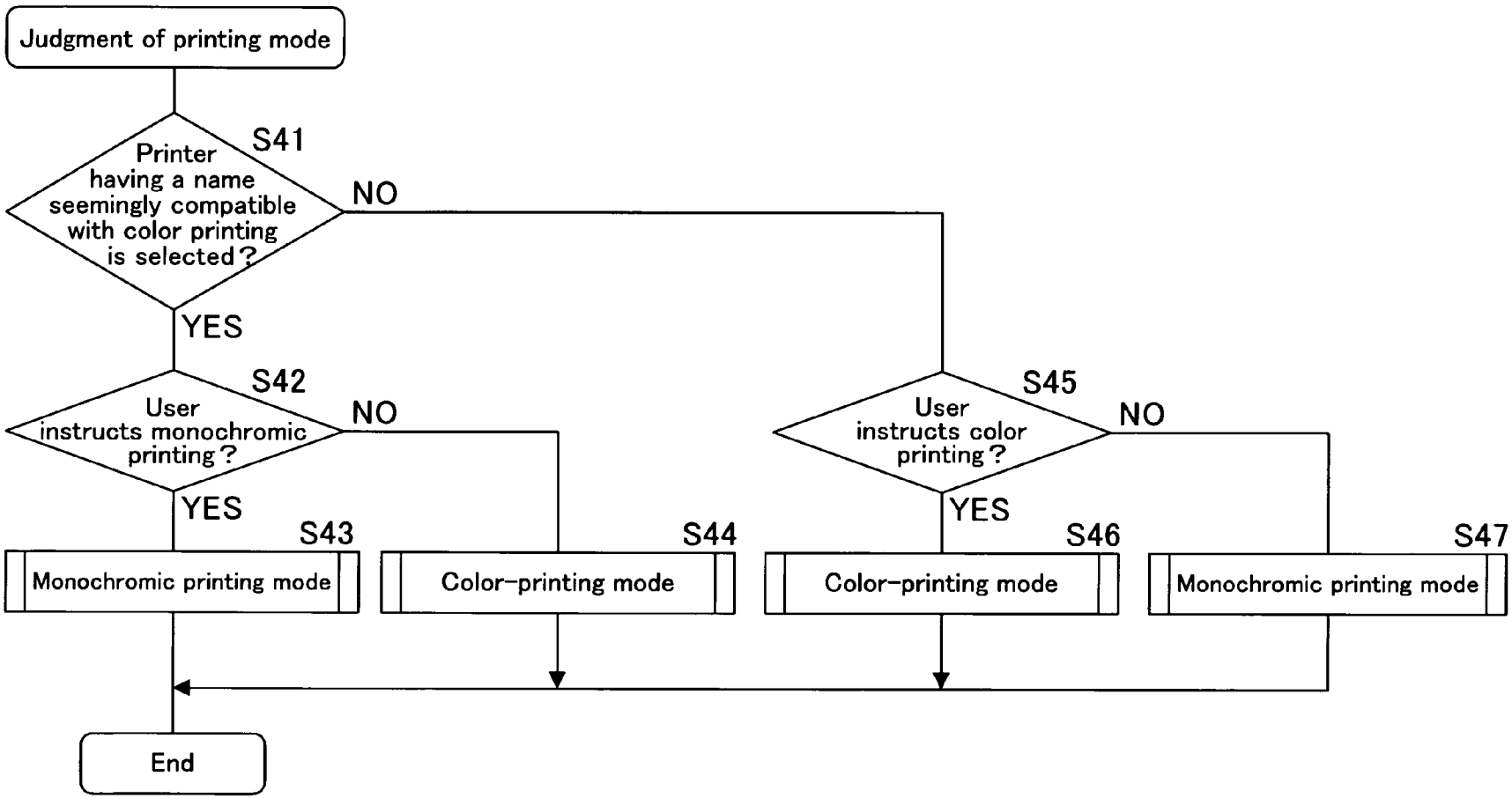
FIG. 8 is a flowchart showing printing mode-judging processing, which is performed after the printer is switched from in the monochromic-machine specification to in the color-machine specification.

FIG. 8 is a flowchart showing the processing for judging the printing mode performed by the PC 600 after switching of the printer 500 from the monochromic-machine specification to the color-machine specification.

It is judged whether the user selects the printer displayed by the switched name in step S41, and if the printer of the switched name is selected (YES in step S41), it is judged whether the user selects the monochromic printing mode in step S42.

If the user selects the monochromic printing mode (YES in step S42), it is judged that the printing mode of the printer 500 is in the monochromic printing mode in step S43, and the printer 500 performs monochromic printing. If the user does not selects the monochromic printing mode (NO in step S42), it is judged that the printer is in the color printing mode in step S44.

If the user does not select the printer displayed by the switched name in step S41 (NO in step S41), it is judged whether the user is selecting the color printing mode in step S45.

If the user selects the color printing mode (YES in step S45), it is judged that the printer is in the color printing mode in step S46. If the user does not selects the color printing mode (NO in step S45), it is judged that the printer is in the monochromic printing mode in step S47.

Hereinafter, another embodiment of the present invention will be described with reference to drawings.

Figure 9:
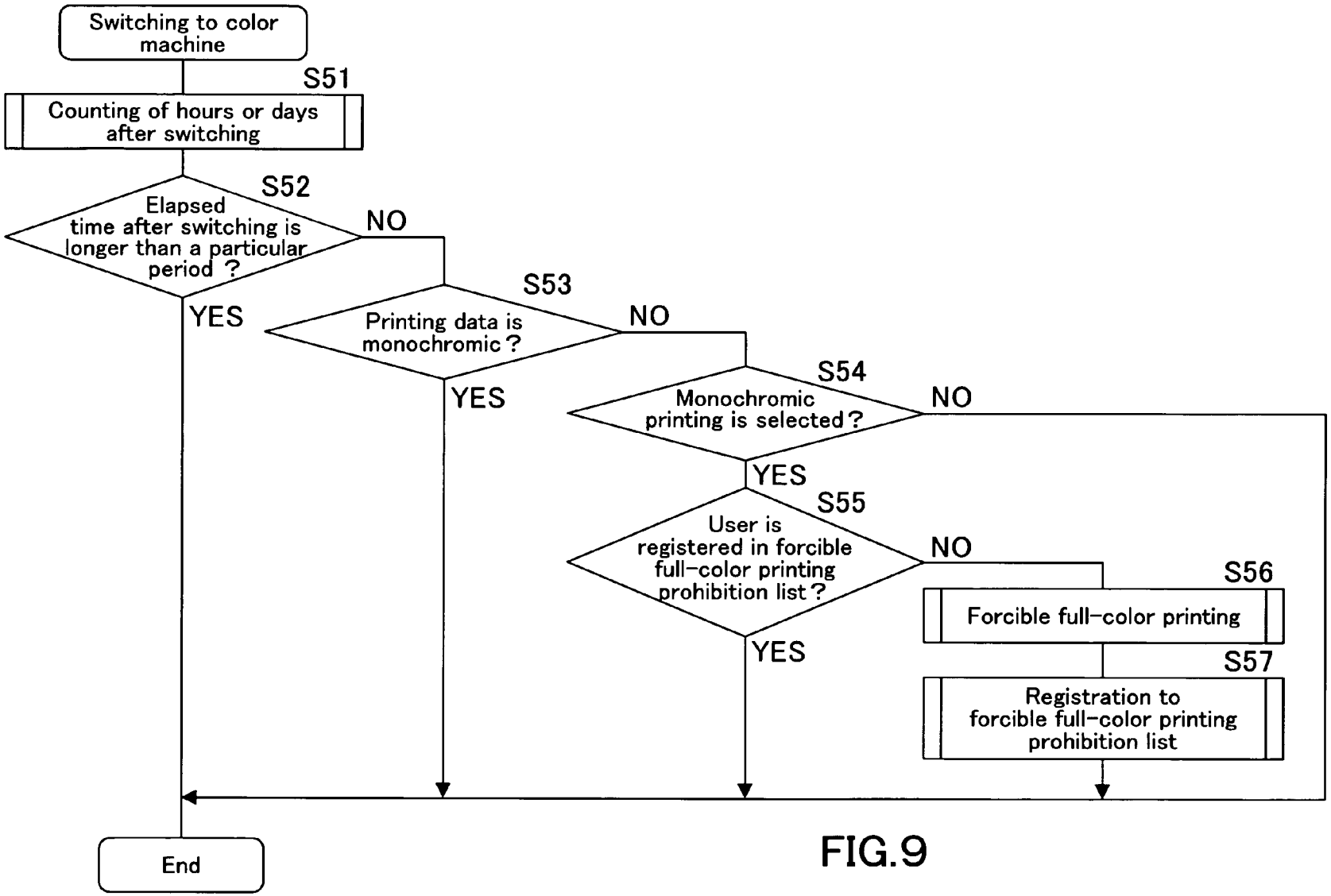
FIG. 9 is a flowchart showing the processing to notify the user of the fact that the full-color printing function is added by performing full-color printing forcibly when the printer is switched from in the monochromic-machine specification to in the color-machine specification.

FIG. 9 is a flowchart showing the processing to notify the user of the fact that full-color printing function is added, by forcibly performing full-color printing when the printer 500 is changed from in the monochromic-machine specification to in the full-color machine specification.

In FIG. 9, when the monochromic-machine specification is replaced with the color-machine specification, the controller 510 of printer 500 counts the period (hours or days) from detection of the switching of engine-controlling unit 520 in step S51, and determines whether the period is longer than a particular period predetermined for example by a manager in step S52. The processing for counting the period (hours or days) from detection of the switching from the monochromic-machine specification to color-machine specification may be performed by the engine-controlling unit 520.

If the period after switching to the color-machine specification is longer than a particular period (YES in step S52), the processing terminates then. If it is not longer than the particular period (NO in step S52), it is judged whether the printing data transmitted from PC 600 is monochromic data in step S53. If the printing data is monochromic data (YES in step S53), the processing terminates then.

If the printing data is not monochromic (NO in step S53), it is judged whether the monochromic printing mode is selected in step S54; if the monochromic printing mode is selected (YES in step S54), the processing advances to step S55; and if the monochromic printing mode is not selected (NO in step S54), the processing terminates then.

It is judged whether the user identification (identifiable) information, for example the IP address of user (PC 600), is registered in the forcible full-color printing prohibition list stored in the nonvolatile memory 511 or 521 in step S55; and, if the IP address is registered in the forcible full-color printing prohibition list (YES in step S55), the processing terminates then.

If the user IP address is not registered in the forcible full-color printing prohibition list (NO in step S55), full color printing is performed forcibly, independently of the printing mode selected by the user in step S56. Then in step S57, the IP address of the user which is subjected to the forcibly full color printing is registered in the forcible full-color printing prohibition list in the nonvolatile memory 511 or 521. The user registered in the list is excluded from the candidates of forcible full-color printing. Accordingly, full-color printing is performed forcibly during the job first instructed by the user after switch of the specification of printer 500, only when the monochromic printing mode is selected even though full-color printer is possible. The user can recognize the fact that full-color printing function is added to the printer 500 by performing the full-color printing forcibly in this manner.

Figure 10:
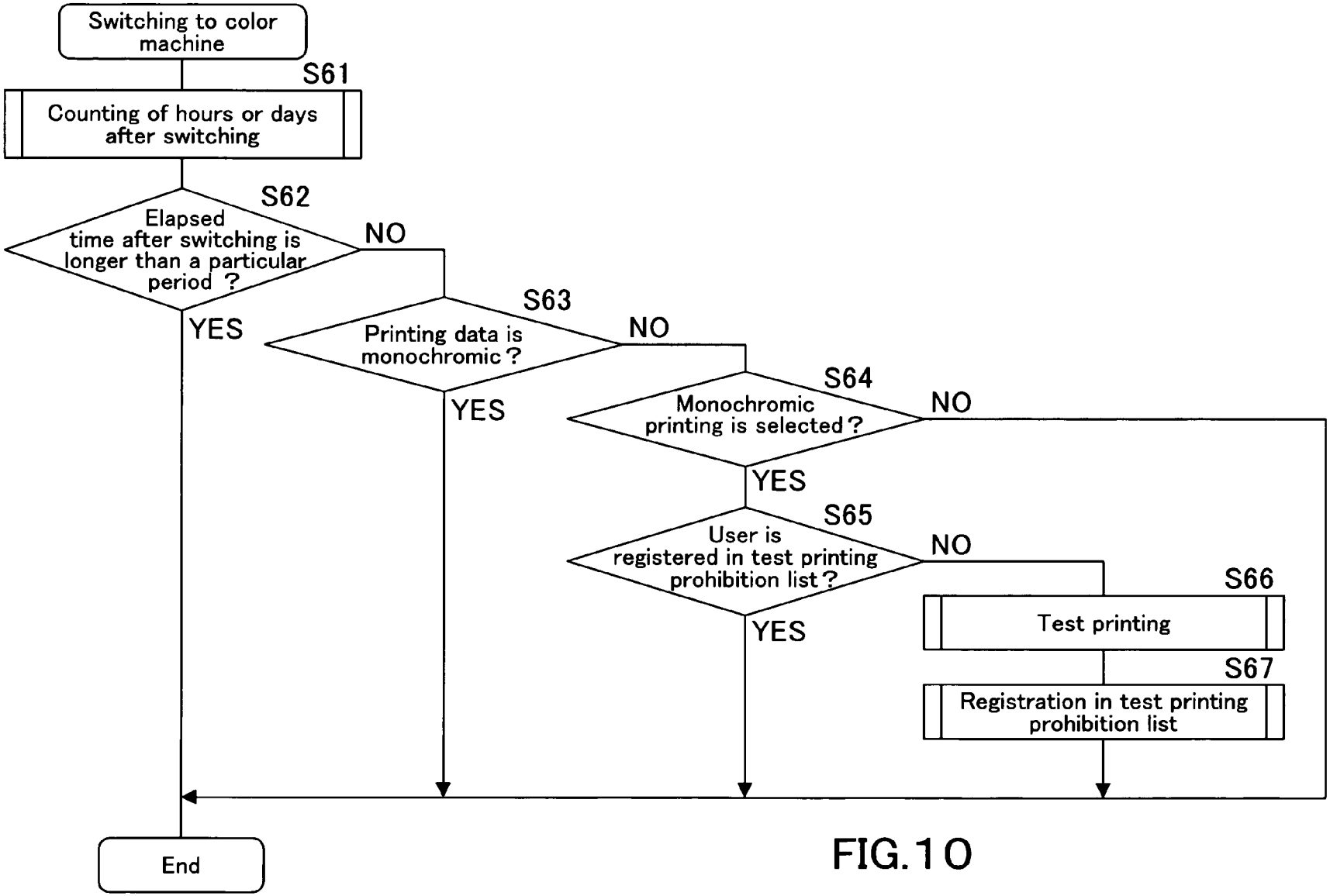
FIG. 10 is a flowchart showing the processing to notify the user of the fact that the printer is switched by discharging a full-color test print when the printer is switched from in the monochromic-machine specification to in the color-machine specification.

FIG. 10 is a flowchart showing the processing to notify the user of the fact of switching, by discharging a full-color test print when the printer 500 is switched from in the monochromic-machine specification to in the color-machine specification.

In FIG. 10, when the monochromic-machine specification is replaced with color-machine specification, the controller 510 of printer 500 counts the period (hours or days) from detection of the switching of engine-controlling unit 520 in step S61, and determines whether the period is longer than a particular period predetermined for example by a manager in step S62. The processing of counting the period (hours or days) from detection of the switching from the monochromic-machine specification to color-machine specification may be performed by the engine-controlling unit 520.

If it is longer than the particular period after switching to the color-machine specification (YES in step S62), the processing terminates then. If it is not longer than the particular period (NO in step S62), it is judged whether the printing data transmitted from PC 600 is monochromic data in step S63. If the printing data is monochromic data (YES in step S63), the processing terminates then.

If the printing data is not monochromic (NO in step S63), it is judged whether the monochromic printing mode is selected in step S64; if the monochromic printing mode is selected (YES in step S64), the processing advances to step S65; and if the monochromic printing mode is not selected (NO in step S64), the processing terminates then.

It is judged whether the user IP address of user (PC 600) is registered in the test printing prohibition list stored in the nonvolatile memory 511 or 521 in step S65; if the IP address is registered in the test printing prohibition list (YES in step S65), the processing terminates then.

If the user IP address is not registered in the test printing prohibition list (NO in step S65), in step S66, a test printing, specifically of adding a full-color test print to the user-designated print job, is performed. The IP address of the user after test printing is registered in the test printing prohibition list in the nonvolatile memory 511 or 521 in step 567. The user registered in the list is excluded from the candidates of test printing. Accordingly, a full-color test print is added to the normal print obtained by execution of the job, and both are discharged, in the job first instructed by the user after switching of the specification of printer 500, only when the monochromic printing mode is selected even though full-color printer is possible.

Thus by discharging the full-color test print, the user can recognize the fact that the full-color printing function is added to the printer 500 easily.

Although methods of notifying the user of the fact that the full-color printing function added to the printer 500 when it is added are mainly described in the embodiments shown in FIGS. 2 to 10, there may be still users who do not notice the fact that the full-color printing function is added.

It is thus recommended to notify the fact once again to the user who does not recognize that the full-color printing function is added.

Figure 11:
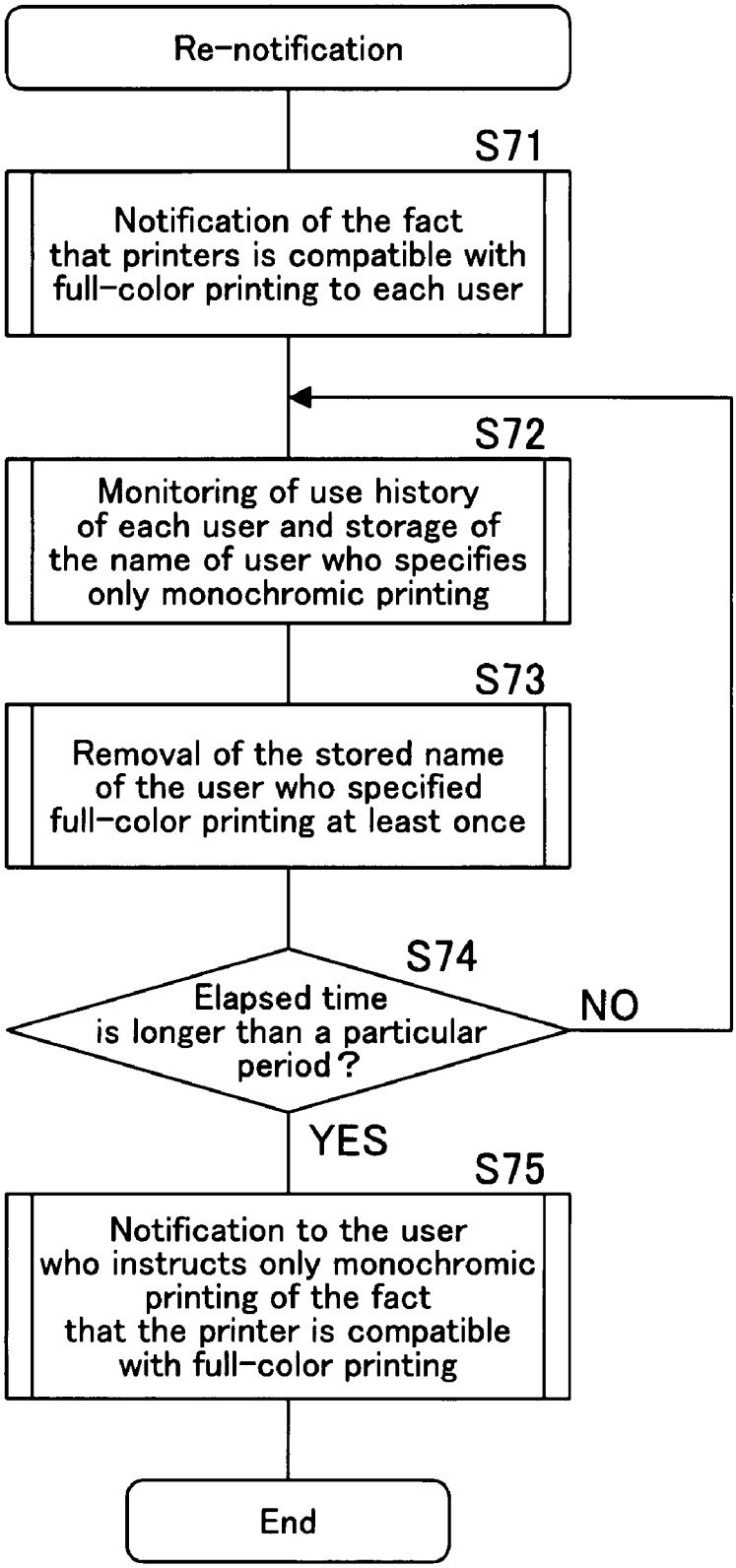
FIG. 11 is a flowchart showing the processing to re-notify the user.

FIG. 11 is a flowchart showing the processing to notify the user once again.

In FIG. 11, the printer 500 notifies each user that the printed is now in the full-color compatible color-machine specification in step S71. In step S72, the printer 500 monitors the use history of each user after switching to the full-color-compatible color-machine specification, and stores the name of the user who selects only the monochromic printing mode in the nonvolatile memory 511 in the controller 510 of printer 500.

If the user registered therein selects the full-color printer mode even once, the name of the user is eliminated from the memory 511 in step S73; it is judged whether the time elapsed a certain period after switching to the color-machine specification in step S74; and if the elapsed time is not longer than a particular period (NO in step S74), the processing goes back to step S72 and the use history is continued to be monitored. If the elapsed time is longer than a particular period (YES in step S74), in step S75, the printer 500 notifies the user who uses only monochromic printing mode that the printer is compatible with full color printing.

Figure 12:
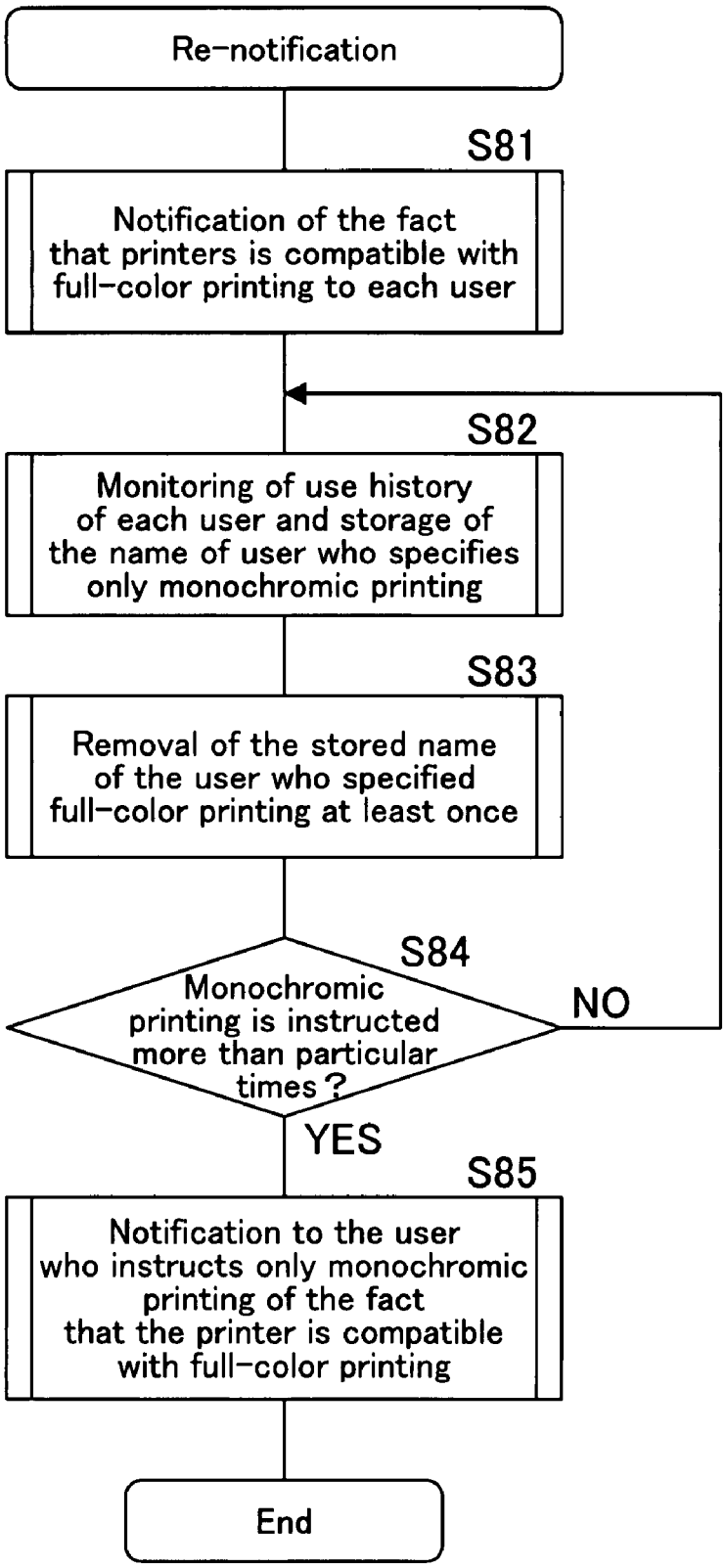
FIG. 12 is a flowchart showing another example of the re-notification processing to the user.

FIG. 12 is a flowchart showing another example of the processing to notify the user once again. In the present example, the re-notification is sent only to the user who selected only the monochromic printing mode at least particular times.

In FIG. 12, the printer 500 notifies each user that the printer is now in the full-color-compatible color-machine specification in step S81. In step S82, the printer 500 monitors the use history of each user after switching to the full-color-compatible color-machine specification, and stores the name of the user who selects only the monochromic printing mode in the nonvolatile memory 511 in the controller 510 of printer 500.

If the user registered therein selects the full-color printer mode at least once, the name of the user is eliminated from the memory 511 in step S83; it is judged whether the monochromic printing mode is selected more than particular times in step S84; and if not (NO in step S84), the processing goes back to step S82 and the use history is continued to be monitored. If the monochromic printing mode is selected more than particular times (YES in step S84), the printer 500 notifies the user who selected only monochromic printing mode at least particular times that the printer is now compatible with full color printing in step S85.

Figure 13:
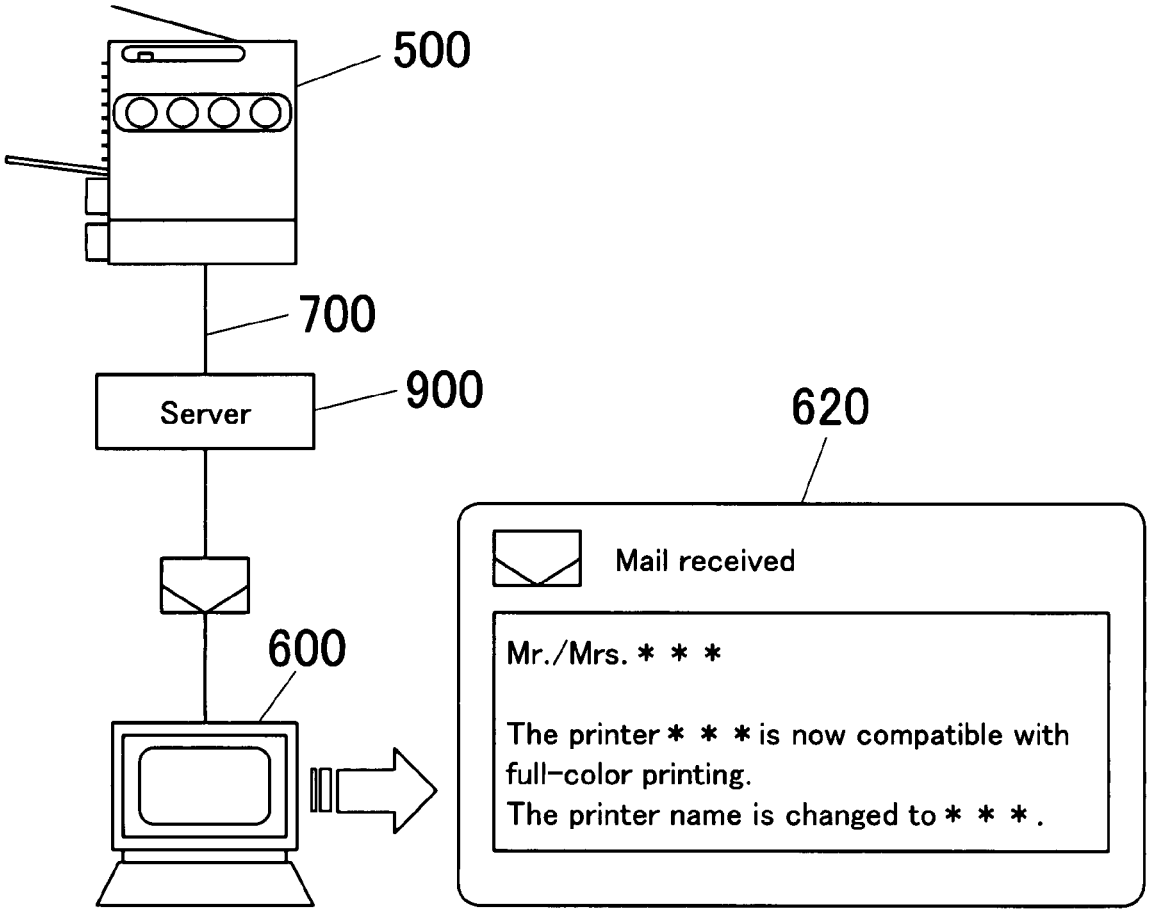
FIG. 13 is an explanatory view illustrating a method of notifying the user that the printer is compatible with full color printing.

FIG. 13 is an explanatory drawing showing the method of re-notifying the user that the printer 500 is compatible with full color printing.

When the printer 500 becomes compatible full-color printing, the printer 500 sends an electronic mail via the server 900 to the PC 600 of the user who seems to be unaware of the fact that it is compatible with full-color printing by the processing shown in FIG. 11 or 12.

Upon receipt of the electronic mail, the PC 600 displays the user name and the description of the e-mail that * is now compatible with full-color printing and the printer name is changed to *." on the display 620.

The re-notification by using an electronic mail makes it easier and reliable to notify the user that the printer 500 is compatible with full color printing.

Figure 14:
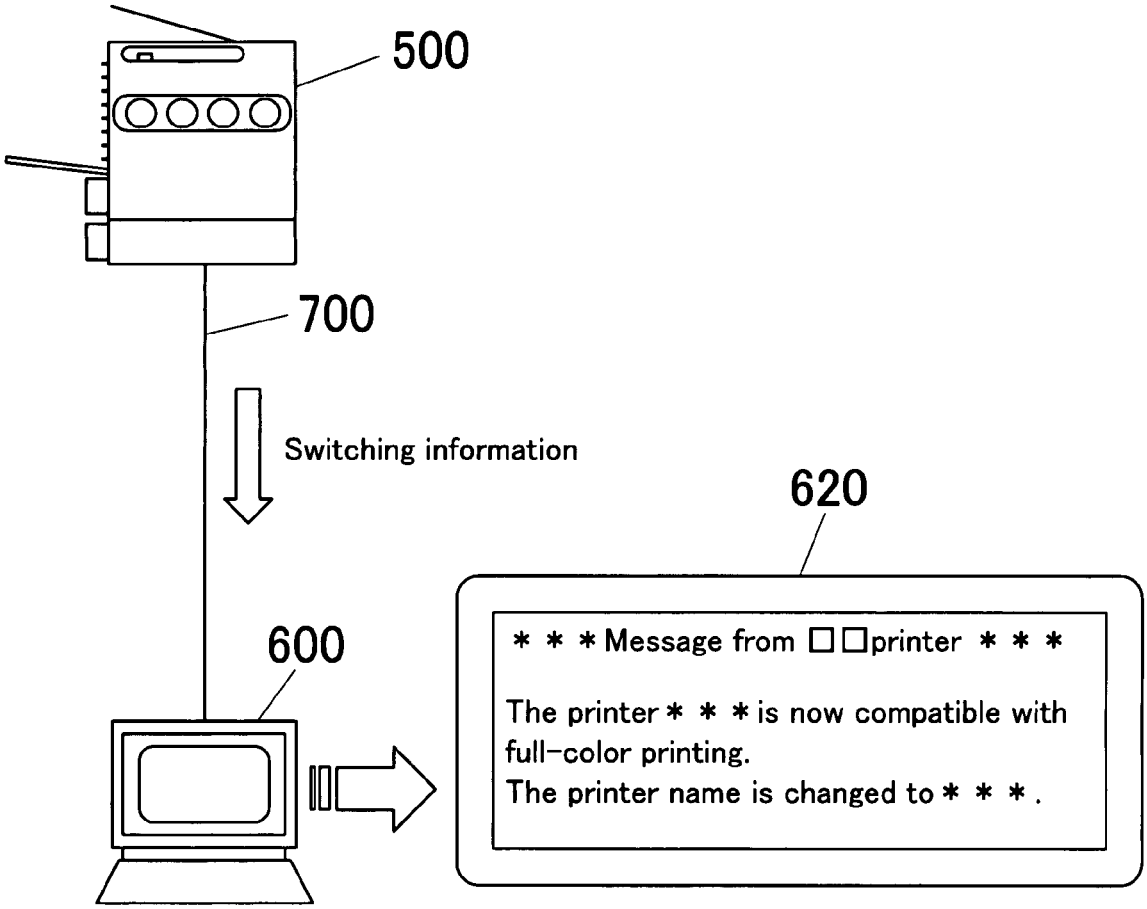
FIG. 14 is an explanatory view illustrating another method of notifying the user that the printer is compatible with full color printing.

Instead of re-notification by electronic mail, the user name and the messages that "* is now compatible with full-color printing and the printer name is changed to * may be pop-up displayed on the display 620 of PC 600 as shown in FIG. 14.

The visual re-notification by the pop-up display on the screen of the display 620 of PC 600 in this manner makes it easier and reliable to notify the user that the printer 500 is compatible with full color printing.

In the embodiments described above, the image forming device 500 is a printer, the first function, a monochromic printing function, and the second function, a full-color printing function; but the kinds of the image forming device and the first and second functions are not limited thereto. However, if the second function is higher functionally than the first function, use of the second function is more advantageous for the user, and thus, it is more advantageous to notify the user that the second function is added. Hereinafter, other applicable embodiments will be described.

(I) the first function is a function to convert data into the PDF format, and the second function a function to convert data into the compact PDF format (character, photograph, and drawing are grouped separately, compressed separately by the optimal compression method, and stored in a PDF file).

Addition of the second function prevents deterioration in image quality and allows reduction of the file size.

When such a function is added, the fact is notified to the user who uses only the first function, i.e., PDF-converting function.

(II) The first function is a function to transmit G3-protocol facsimiles and the second function is a scanning function that is made available by addition of a scan application. The second function may be an Internet FAX function or an SIP (Session Initiation Protocol) FAX function.

Addition of the second function, the Internet FAX function or SIPFAX function, leads to further reduction in communication cost, and the fact is notified to the user who uses the first function, G3 FAX function, that is higher in communication cost.

(III) Miscellaneous

When the first function is a single-sided two-in-one (manuscripts on two pages printed on a single paper) function and the second function is double-faced printing function, the fact is notified to the user who uses only single-sided two-in-one function.

When the first function is a scan-to-FTP server function and the second function is a box function by using a hard disk, the fact is notified to the user who uses only the scan-to-FTP server function.

When the first function is a function to transmit a received manuscript to a destination at a single site and the second function is a simultaneous transmission function, the fact is notified to the user who repeats reading and transmitting the same manuscript to a single site several times while changing the destination.

In the embodiments above, the fact that the second function is added is displayed on the display 620 of PC 600, but may be notified to the user, as it is displayed, for example, on the display panel of the image forming device 500. The image forming device 500 performed the second function forcibly or in test in the embodiments above, but the image forming device may perform the second function forcibly or in test, based on the control by the information processing device.

In addition, the image forming device 500 managed the use history of each user, and the image forming device re-notified by electronic mail to a certain user, or the information processing device 600 re-notified by pop-up display in the embodiments above, but the re-notification may be delivered from the display unit of the image forming device or from an information processing device such as printer server by electronic mail.

That is, the notification means, re-notification means, or the like may be present at least in one of the image forming device and information processing device.

The fact that the second function is added was detected by the engine-controlling unit 520 of image forming device 500 above, but may be alternatively detected by the information processing device 600.

For example, the driver of the information processing device 600 obtains and stores the functional information of the image forming device, when it accesses to the image forming device 500 in bidirectional communication with the image forming device 500.

If the user continues to use the function before improvement even though improvement in function is observed when the functional information obtained when the information processing device 600 accesses to the image forming device 500 and the functional information obtained during previous access are compared, it is possible to inform the user that the function is upgraded by displaying the fact on the display 620 of the information processing device 600.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrate herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present invention. The limitation in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "not well."

What is claimed is:

1. An image forming system including an image forming device having a first function and an information processing device connected to the image forming device, comprising:

a function-detecting unit detecting that a second function is added to the image forming device, and a notification unit notifying a user using the image forming device of the fact that the second function is added, when the addition of the second function is detected by the function-detecting unit, wherein, when the processing by the first function is selected even though the job first instructed to the image forming device by the user is a job to be performed by the second function after addition of the second function to the image forming device, the notification unit notifies that the second function is added, by making the image forming device perform the job forcibly by the second function.

2. An image forming system including an image forming device having a first function and an information processing device connected to the image forming device, comprising: a function-detecting unit detecting that a second function is added to the image forming device, and a notification unit notifying a user using the image forming device of the fact that the second function is added, when the addition of the second function is detected by the function-detecting unit, wherein, when the job first instructed to the image forming device by the user is a job by selection of the first function after addition of the second function to the image forming device, the notification unit notifies that the second function is added, by making the image forming device perform the job by the first function and also the job by the second function.

3. The image forming system according to claim 1, further comprising a re-notification unit of re-notifying the user who uses only the first function of the image forming device after addition of the second function that the second function is added.

4. The image forming system according to claim 3, wherein the re-notification unit re-notifies the user who uses only the first function of the image forming device at least particular times that the second function is added.

5. The image forming system according to claim 1, wherein the first function is a monochromic printing function and the second function is a full-color printing function.

6. An image forming device having a first function, comprising:

a function-detecting unit detecting that a second function is added to the image forming device, and a notification unit notifying to a user who uses the image forming device that the second function is added, when the addition of the second function is detected by the function-detecting unit, wherein, when the processing by the first function is selected even though the job first instructed to the image forming device by the user is a job to be performed by the second function after addition of the second function to the image forming device, the notification unit notifies that the second function is added, by making the image forming device perform the job forcibly by the second function.

7. An image forming device having a first function, comprising:

a function-detecting unit detecting that a second function is added to the image forming device, and a notification unit notifying to a user-who uses the image forming device that the second function is added, when the addition of the second function is detected by the function-detecting unit, wherein, when the job first instructed to the image forming device by the user is a job by selection of the first function, the notification unit notifies that the second function is added, by making the image forming device perform the job by the first function and also the job by the second function.

8. The image forming device according to claim 6, further comprising a re-notification unit of re-notifying the user who uses only the first function of the image forming device after addition of the second function that the second function is added.

9. The image forming device according to claim 8, wherein the re-notification unit re-notifies the user who uses only the first function of the image forming device at least particular times that the second function is added.

10. The image forming device according to claim 6, the first function is a monochromic printing function and the second function is a full-color printing function.

11. The image forming device according to claim 7, further comprising a re-notification unit for re-notifying the user who uses only the first function of the image forming device after addition of the second function that the second function is added.

12. The image forming device according to claim 11, wherein the re-notification unit re-notifies the user who uses only the first function of the image forming device at least at particular times that the second function is added.

13. The image forming device according to claim 7, the first function is a monochromic printing function and the second function is a full-color printing function.

14. The image forming system according to claim 2, further comprising a re-notification unit of re-notifying the user who uses only the first function of the image forming device after addition of the second function that the second function is added.

15. The image forming system according to claim 14, wherein the re-notification unit re-notifies the user who uses only the first function of the image forming device at least particular times that the second function is added.

16. The image forming system according to claim 2, wherein the first function is a monochromic printing function and the second function is a full-color printing function.

17. The image forming device according to claim 7, further comprising a re-notification unit of re-notifying the user who uses only the first function of the image forming device after addition of the second function that the second function is added.

18. The image forming device according to claim 17, wherein the re-notification unit re-notifies the user who uses only the first function of the image forming device at least particular times that the second function is added.

19. The image forming device according to claim 7, the first function is a monochromic printing function and the second function is a full-color printing function.

* * * * *